US006093430A

United States Patent [19]

Gupta

[11] Patent Number: 6,093,430

[45] Date of Patent: Jul. 25, 2000

[54] PRECISE RECIPE SPICE DISPENSER

[76] Inventor: Suresh Gupta, 9899 Santa Monica Blvd. #276, Beverly Hills, Calif. 90212

[21] Appl. No.: 09/239,601

[22] Filed: Jan. 29, 1999

[51] Int. Cl.[7] ..... B65D 1/36; B65D 17/32; B65D 85/00

[52] U.S. Cl. ..... 426/115; 426/87; 426/120; 426/122; 206/232; 206/459.5; 220/23.8; 220/268; 220/507; 229/123.2

[58] Field of Search ..... 426/122, 123, 426/119, 106, 120, 115, 108, 87; 220/507, 268, 23.8, 257, 526, 265; 229/123.2, 123.1, 125.35; 206/232, 459.5

[56] References Cited

U.S. PATENT DOCUMENTS

| | | | |
|---|---|---|---|
| 2,705,579 | 4/1955 | Mason . | |
| 2,745,751 | 5/1956 | Pichardo . | |
| 3,158,491 | 11/1964 | Farrell et al. | 426/122 |
| 3,185,578 | 5/1965 | Scharre | 426/122 |
| 3,298,505 | 1/1967 | Stephenson | 426/123 |
| 3,394,861 | 7/1968 | Truax | 426/120 |
| 3,394,869 | 7/1968 | Fontana et al. | 426/120 |
| 3,428,460 | 2/1969 | Ely | 426/120 |
| 4,096,948 | 6/1978 | Kuchenbecker | 426/122 |
| 4,249,483 | 2/1981 | Sobky | 426/120 |
| 4,299,851 | 11/1981 | Lowe . | |
| 4,361,227 | 11/1982 | Paulucci | 426/120 |
| 4,790,429 | 12/1988 | Fukushima . | |
| 5,316,400 | 5/1994 | Hoyt et al. . | |
| 5,529,179 | 6/1996 | Hanson . | |
| 5,664,670 | 9/1997 | Cozzie . | |

OTHER PUBLICATIONS

Food Engineering Apr. 1951, R183,194 426/120.

*Primary Examiner*—Steven Weinstein
*Attorney, Agent, or Firm*—Walter Unterberg

[57] ABSTRACT

This Precise Recipe Spice Dispenser is an aid to cooks, providing accurate and speedy dispensing of proper amounts of spices in correct sequence for a given recipe. A transparent plastic form contains a series of separate trough-shaped spice compartments with open faces. The sequence and sizes of the compartments depend on the order and amounts of the individual spices required. The plastic form, when filled with the spices, is sealed to the front layer of a double-layer chipboard backing, such that the open periphery of the spice compartments exactly matches a cutout in the front layer. The back layer has a peelable strip with a peripheral perforation exactly back-to-back with the cutout periphery in the front layer. The names of the spices and the recipe as a whole may be printed on the front layer next to the sealed spice compartments. When the first spice is needed, the peelable strip is peeled back to expose just the first compartment, leaving the other compartments sealed. Subsequently, the strip is peeled to dispense the remaining spices one at a time, after which the strip becomes separated and may be discarded. If the same recipe is to be used again, the spice compartments can be refilled with spices as before and the peelable strip replaced. The Spice Dispenser is then ready to be used another time.

8 Claims, 1 Drawing Sheet

FIG. 1
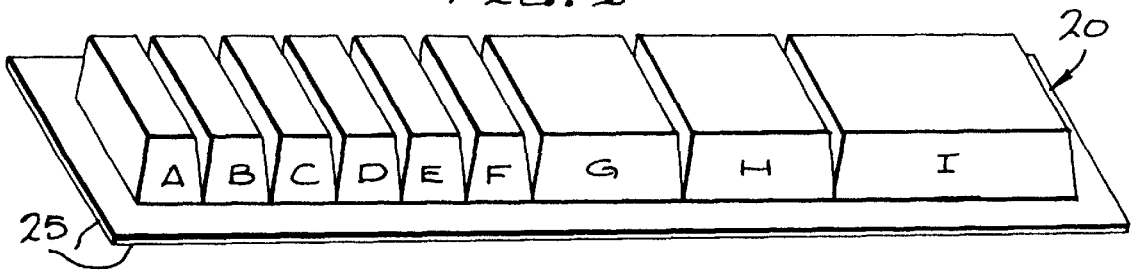
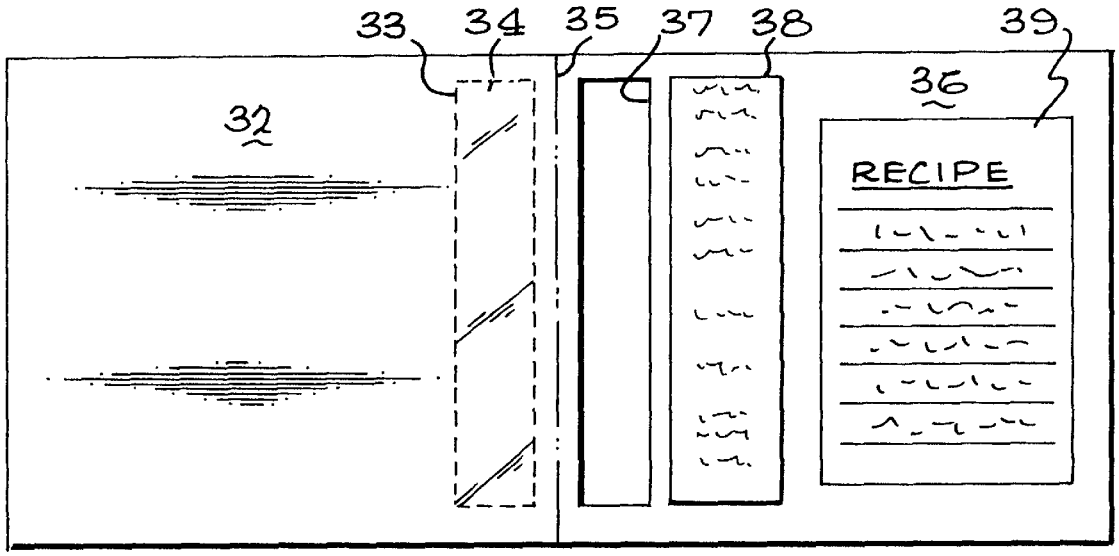
FIG. 3
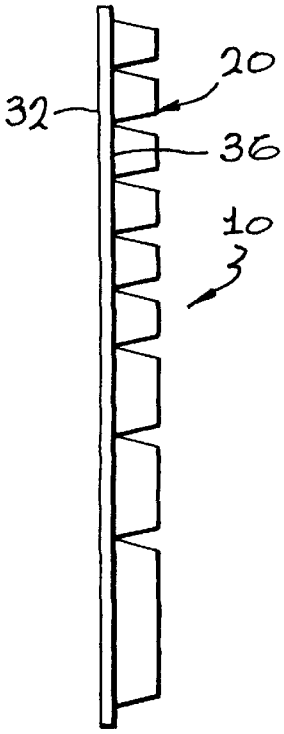
FIG. 2
FIG. 4
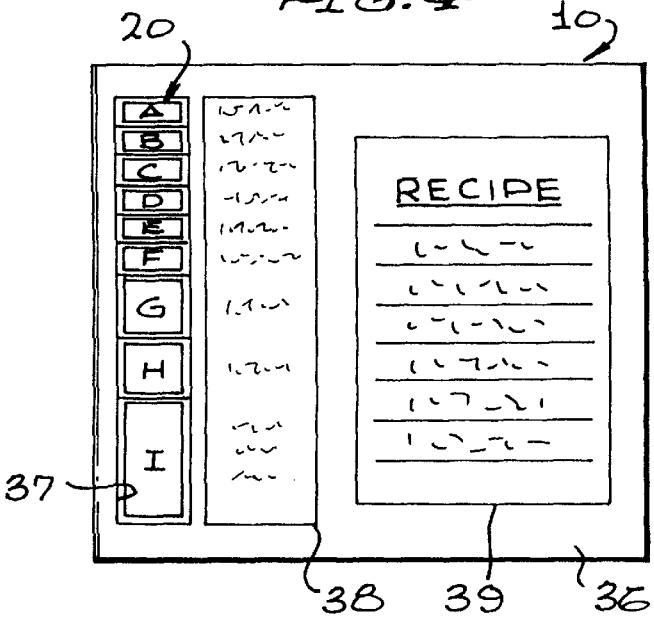

PRECISE RECIPE SPICE DISPENSER

BACKGROUND OF THE INVENTION

1. Field of the Invention

This invention relates to preloaded dispensers of several different substances in a predetermined sequential manner. More particularly, it relates to sequential dispensing of various spices in different amounts, as required for specific kitchen recipes which are packaged together with the spices.

2. Description of Related Art

Presently a cook obtains kitchen recipes from cookbooks, recipe cards, newspapers, or notes. Then the cook must list the various ingredients and spices (types and amounts) required by the recipe and procure them from a food market. While ingredients, such as meats, vegetables, grains, fats and the like, are fairly straightforward to procure, spices require more care. Sometimes a spice is known by more than one name, or may not be available in the prescribed form (such as ground, chopped, dried, freeze-dried, or other) or not at all. Then time must be spent looking for spices at other markets.

Many spices are very expensive, and if packaged quantities are more than what the recipe requires, money may be wasted. If spices have been stored in the kitchen for long periods of time because of infrequent use, they may have lost their flavor and become stale because of their finite shelf life.

Once spices from various sources and ingredients have been assembled for use in cooking the recipe, cooks may be distracted by the mechanics of food preparation which may involve multiple pots and pans, hot stoves, and moving ingredients and spices back and forth. The result is that spices (and ingredients) could be spilled, incorrect amounts could be measured out, and the chances for other errors in food preparation could be increased.

There is thus a need for means to ease food preparation with multiple spices, so that expense and time required are minimized, while accuracy of proper addition of the various spices, and thus the quality of the prepared food, are maximized.

All this is not a new problem and in the past a number of devices which dispense measured amounts of packageable spices and ingredients have been proposed. A search of the patent literature has uncovered the following related U.S. patents:

No. 2,745,751 to Pichardo,

No. 2,705,579 to Mason,

No. 4,299,851 to Lowe,

No. 4,790,429 to Fukushima,

No. 5,316,400 to Hoyt et al,

No. 5,529,179 to Hanson, and

No. 5,664,670 to Coxxie.

All these patents show pockets of round, square or rectangular shape dispensing particulate solids. Lowe deals with only one substance which is self-released during cooking by thermal action. The others have multiple pockets. Fukushima and Hoyt et al arrange for simultaneous release from all pockets by a single opening action. The four remaining patents allow for opening of individual pockets in an arbitrary sequence as desired by the cook.

None of the seven patents reviewed have the following features which are very helpful in the preparation of complex recipes:

1. A controlled prescribed sequence of opening of multiple pockets containing different spices or ingredients;

2. A mechanical arrangement of such multiple pockets which allows refilling and re-use by simple retrofitting of the opening mechanism; and
3. A printed recipe included near the spice pockets for convenience and timesaving in preparation of food according to the recipe.

OBJECTS OF THE INVENTION

The objects of the invention are to provide a Precise Recipe Spice Dispenser for a specific recipe which 1. contains the precise amounts of all the spices required for the recipe, with each spice properly labeled;
2. presents the spices in sequential order as called for in the recipe;
3. provides a convenient and speedy means of removing each spice when needed;
4. is integrated with the printed recipe directions in a small self-contained package, so that the cook can dispense the spices faster and cook the recipe with less chance of error; and
5. eliminate the need for for shelf space for individual spice containers and avoids the extra time required for moving back and forth between mixing, cooking and related equipment and the spice shelf during the cooking process.

SUMMARY OF THE INVENTION

To implement the above-stated objects of the invention a Precise Recipe Spice Dispenser has been devised. This Dispenser consists of a clear plastic form attached to a double-layer chipboard backing. One layer is designated the front panel and the other layer the rear panel. The panels are of identical size and shape and are attached back to back.

The clear plastic form consists of a number of sequential adjacent spice compartments in series to accommodate all the spices needed for a given recipe. The spice compartments, typically open hollow boxes of trapezoidal cross-section, all have the same width and height, but vary in length to accommodate the varying volumes of the individual required spices.

The spice compartments are designed to be separate and self-contained, so that the spice in any one compartment is prevented from mixing with its neighbors. The form includes a peripheral rim all around the spice compartments whereby the plastic form can be hermetically sealed to the front panel of the chipboard backing.

The essence of the instant invention is the provision of a chipboard backing structure to yield, in combination with the clear plastic form, a prescribed sequential dispensing of the assembled spices. This structure consists of (1) a cutout in the front panel exactly matching the open periphery of the clear plastic form with the spice compartments in series; and (2) a peelable strip with a peripheral perforation in the rear panel exactly equal and opposite to the periphery of the cutout in the front panel.

The assembly of the dispenser for a given recipe is performed by first producing the clear plastic form with the proper lengths of the individual adjacent spice compartments, placing the form on a surface with with the compartment openings facing upward, followed by loading the compartments with the proper spice amounts. Then the front panel is placed over the clear plastic form with the cutout exactly overlaying the open periphery of the form and the front panel is secured to the peripheral rim of the form. This closes up the spice compartments.

In operation, as one spice after another is required for recipe preparation, the peelable strip on the rear panel is peeled back to open up one spice compartment after another in the order prescribed by the recipe. There is no possibility of changing the order of spice addition. This is the novel feature of this Dispenser. Furthermore, the front panel can carry the names of the spices next to the compartments, as well as the entire recipe.

Thus, this Dispenser is of great value in the preparation of gourmet foods requiring a number of spices. The objects of the invention stated above have all been realized.

When all the spices have been dispensed, the peelable strip has been completely peeled away from the rear panel and can be discarded. Now there exists the possibility of reusing the Dispenser for the same recipe by refilling the compartments of the plastic form, still attached to the front panel, and replacing the rear panel with a new panel with an intact peelable strip.

BRIEF DESCRIPTION OF THE DRAWINGS

A better understanding of the invention may be gained by reference to the following Derailed Description in conjunction with the drawings provided in which:

FIG. 1 is a pictorial view of the clear plastic form;

FIG. 2 is a front view of the chipboard front panel; and a front view of the chipboard rear panel;

FIG. 3 is a side view of the assembled Dispenser; and

FIG. 4 is a front view of the assembled Dispenser.

DETAILED DESCRIPTION OF THE PREFERRED EMBODIMENTS

The components of the Precise Recipe Spice Dispenser are the clear plastic form 20 shown in FIG. 1, chipboard front panel 36 shown in FIG. 2, and chipboard rear panel 32 shown in FIG. 2. The Dispenser 10 assembled from these components is shown in FIG. 3 and FIG. 4.

Referring now to FIG. 1, the clear plastic form 20 is produced from a single sheet, typically by a molding process, to provide an in-line plurality of spice compartments A, B, C, . . . I . . . or as many or as few as are needed for the recipe in question. The sequence and individual sizes of the spice compartments are determined by the specific recipe for which spices are to be provided.

A peripheral rim 25 around all the spice compartments can be tightly sealed to a plane surface after each compartment has been properly filled with the requisite spice amount. Such an arrangement keeps each spice compartment sealed until the time when the compartment is opened to discharge its particular spice into a designated vessel.

Referring now to FIG. 2, the chipboard front panel 36 and the chipboard rear panel 32 have the same peripheral dimensions and may be made out of two pieces of identical planform or out of one double-size piece folded at linear fold 35.

Front panel 36 is provided with a cutout 37 to which form 20, after having beeen filled with all the spices, is tightly secured, such as by glueing all around rim 25. Cutout 37 has the proper dimensions to accommodate the linear compartments A, B, C, . . . I. Next to the spice compartments there are printed the names of the specific spices contained in the compartments on a label 38 affixed to front panel 36. Alternatively, these names 38 can be printed directly on front panel 36. The remaining space 39 on front panel 36 contains the instructions for cooking the recipe for which the various spices have been assembled.

FIG. 2 shows the chipboard rear panel 32 which is provided with a peripheral perforation 33 identical in size and location to cutout 37 on front panel 36. Perforation 33 encloses peelable strip 34 which is arranged to peel from the top, where compartment A is located. Thus when panels 36 and 32 are superimposed, strip 34 can be peeled from the top down to open up compartments A, B, etc. in proper order. The spices are dispensed from the face of rear panel 32, and it can be seen by viewing clear plastic form 20 on front panel 36 which spice compartments have been emptied.

The manufacture and order of assembly of the spice dispenser is thus as follows:

1. Fabricate clear plastic form 20 to suit the spices for a given recipe.
2. Fabricate one-piece or two-piece front panel 36 with cutout 37, and rear panel 32 with peelable strip 34. The combined spice compartments A, B, C . . . I . . . , cutout 37, and peelable strip 34 must all have identical dimensions.
3. Fill spice compartments A, B, C, . . . I . . . of form 20 with the proper spices.
4. Glue (or otherwise attach) rim 25 of filled form 20 to front panel 36 such that the spice compartments A, B, etc. exactly overlay cutout 37.
5. Attach panels 32 and 36 to each other back-to-back such that peelable strip 34 in panel 32 exactly overlays cutout 37 in panel 36.

Referring now to FIG. 3 and FIG. 4, the side view and end view of the assembled dispenser 10 are shown. In operation, peelable strip 34 is pulled back one compartment at a time, exposing spices, A, B, C etc. as needed at the proper time in the cooking procedure. It is impossible to mix up the order and amounts of spice addition with this dispensing arrangement. This is the kernel of the present invention.

The invention may be practiced otherwise than as specifically here described without departing from the invention in its broadest aspects. The aim of the appended claims, therefore, is to cover all such changes and modifications as fall within the true spirit and scope of the invention.

I claim:

1. A precise recipe spice dispenser for the accurate sequential dispensing of spices for a given recipe, said spice dispenser comprising:

a form comprising:

a series of in-line trough-shaped spice compartments with open faces, said compartments being of uniform height and sequenced and sized according to the order of addition and amounts of spices for a given recipe and filled with said spices; and a rim around a periphery of said open faces of said compartments of said uniform height; and a double-layer backing comprising:

a front layer having a cutout identical in size and shape to an area encompassed by said peripheral rim of said form, said rim being sealed around said cutout to said front layer such that said compartments filled with said spices are individually tightly closed with their said open faces contiguous to said front layer; and a rear layer identical in size and shape to said front layer and completely attached over its extent to said front layer, said rear layer having a peelable strip with a peripheral perforation exactly back-to-back with a periphery of said cutout in said front layer, such that said peelable strip can be peeled back to expose one of said compartments after another, and thus accurately dispense one said spice after another in proper sequence with a proper amount of each said spice.

2. The spice dispenser of claim 1 wherein said front layer further carries printed indicia (a) naming the individual spice in each said compartment and (b) with the text of the recipe.

3. The spice dispenser of claim 1 wherein said trough-shaped compartments are box-shaped.

4. The spice dispenser of claim 1 wherein said trough-shaped compartments are trapezoid-shaped.

5. The spice dispenser of claim 1 wherein said form is made of transparent plastic.

6. The spice dispenser of claim 1 wherein said peelable strip, after having completely exposed all said compartments and dispensed all said spices, may be replaced on said rear layer, permitting reuse of the spice dispenser for the same recipe after proper refilling of said compartments.

7. The spice dispenser of claim 1 wherein said double-layer backing is made of one double-sized layer folded in two.

8. The spice dispenser of claim 1 wherein said double-layer backing is made of chipboard.

* * * * *